United States Patent [19]

Uppgren

[11] Patent Number: 4,512,385

[45] Date of Patent: Apr. 23, 1985

[54] MOLD REGISTRATION APPARATUS

[75] Inventor: John J. Uppgren, St. Paul, Minn.

[73] Assignee: FMC Corporation, Chicago, Ill.

[21] Appl. No.: 464,301

[22] Filed: Feb. 7, 1983

Related U.S. Application Data

[63] Continuation of Ser. No. 337,357, Jan. 6, 1982.

[51] Int. Cl.[3] ..... B22C 33/04

[52] U.S. Cl. ..... 164/364; 164/243; 164/341

[58] Field of Search ..... 164/235, 237, 239, 241, 164/243, 249, 349, 364, 365, 366, 368, 370, 379, 382

[56] References Cited

U.S. PATENT DOCUMENTS 573,970 12/1896 Gartside ..... 164/243

FOREIGN PATENT DOCUMENTS 321311 5/1920 Fed. Rep. of Germany ..... 164/243

284425 2/1928 United Kingdom ..... 164/243

*Primary Examiner*—Kuang Y. Lin

*Attorney, Agent, or Firm*—H. M. Stanley; R. B. Megley

[57] ABSTRACT

A locating core for sand molds, has a larger diameter frusto-conical upper portion and a smaller diameter frusto-conical lower portion which are joined together at the bases. A mold cope and drag each have two conical depressions therein adapted to receive the upper and lower portions of the locating core respectively and positioned so that the mold cavities in the cope and drag are in proper registration when the depressions are in registration. A step is formed on the core between the diameters of the bases at the junction of the upper and lower cone portions. The step rests on the upper surface of the drag when the core is set in the drag depressions and the cope is then placed so that the cope depressions engage the upper conical portions, whereby the cope and drag mold cavities are in registration.

6 Claims, 2 Drawing Figures

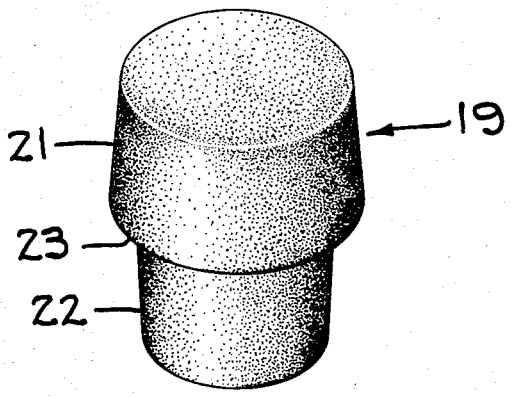
FIG_1
FIG_2
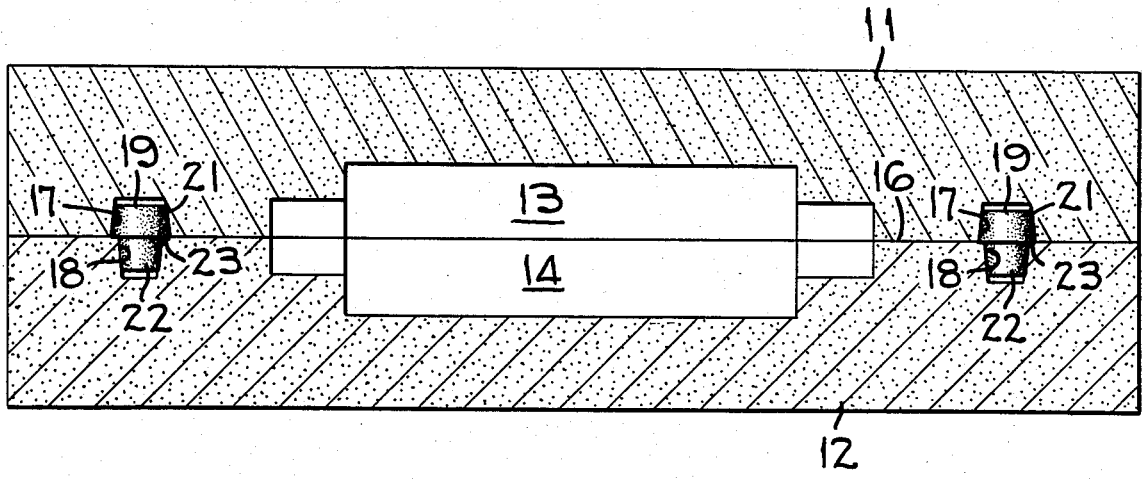

MOLD REGISTRATION APPARATUS

This application is a continuation of application Ser. No. 337,357, filed 1/6/82.

BACKGROUND OF THE INVENTION

1. Field of the Invention

This invention relates to mold assemblies used in the foundry arts, and more particularly to a locating core for providing registration of one mold portion with another mold portion.

2. Description of the Prior Art

When portions of a mold are placed together prior to pouring a liquid therein for producing a molded or cast article, some means must be utilized to register the mold portions so that the cast article takes the intended shape. According to one scheme one portion of the mold is provided with a depression having a particular wall shape and the other portion of the mold is provided with a protrusion having substantially the same wall shape, so that when the two mold portions are placed together with the protrusion positioned in the depression the mold cavity portions in the mold sections are properly aligned. The protrusions on the face of the one mold portion are subject to breakage during handling of the mold prior to mold assembly. As a consequence accurate registration of the mold portions is sometimes lost.

In other instances identical depressions have been made in the mold portions having similar patterns and being positioned in the mold portions so that when a core is engaged by matching depressions in the patterns of depressions the mold cavities are properly registered. The only locating core known to be used in the aforedescribed fashion was shaped like a pair of truncated conical sections having bases of the same diameter and being joined at the bases. The depressions in the pattern had walls which were also frusto-conical. The locating function with the described cores was degraded however, because if one of the frusto-conical depressions was too large the locating core would be inserted too far therein preventing full engagement of the other end of the core by the depression in the other mold half and allowing the other mold half to move in two dimension. Alternatively, if one of the conical depressions was too small in diameter a separation resulted between the mold portions, allowing a ridge of cast material (flashing) to build up along the parting line of the mold. Registration between the mold portions suffers in the first instance and the dimensional integrity and clean up requirements necessary for the end cast articles suffer in the second instance.

SUMMARY OF THE INVENTION

The invention disclosed herein relates to a locating core for registering a cope portion with a drag portion of a mold, and includes a first truncated cone portion and a second truncated cone portion. The first cone portion has a base which is larger than the base of the second cone portion. The first and second cone portions are joined at the bases such that a peripheral step is formed on the locating core at the junction of the cone portions.

According to another aspect of the invention a sand mold locating core is provided for use in obtaining proper registration between a cope and a drag in a sand mold. The cope and drag each have at least two frusto-conical depressions therein with the depressions in the cope having a larger maximum diameter than the depressions in the drag. The depressions in the cope are in registration with the depressions in the drag when the cope is properly oriented over the drag to align the mold cavities therein. A locating core is provided which is received in each set of registered depressions wherein the locating core includes an upper frusto-conical portion and a lower frusto-conical portion. The upper portion has a larger base diameter than the lower portion and the portions are joined at the bases thereof. In this fashion a unitary core is formed having a step thereon extending from the diameter of the lower portion to the diameter of the upper portion. The step is therefore engaged by the surface of the drag portion of the mold when the locating core is placed within one of the smaller diameter depressions in the drag. The entire larger diameter frusto-conical portion of the locating core is therefore available to be engaged by the appropriate large diameter depression in the cope so that lateral two dimensional movement between the cope and drag is minimized and the mold cavities therein are properly aligned during mold assembly. In accordance with yet another aspect of the invention, apparatus is provided for obtaining registration between components of a mold which together define a mold cavity. A cope portion and a drag portion of the mold are provided wherein the cope and drag portions have planar surfaces surrounding the mold cavities therein. The planar surfaces lie in a mold parting plane when assembled to define the mold cavity. A locating core has a first truncated cone portion and a second truncated cone portion with the first portion having a base which is larger than the base of the second portion. The first and second cone portions are joined at their bases so that a peripheral step is formed on the core at the junction. The cope and drag portions of the mold each have at least two depressions therein which are formed to receive said first and second truncated cone portions respectively. The cone portions have height dimensions which are less than the depression depth dimensions so that the peripheral step rests on the drag planar surface and the cope and drag planar surfaces are in abutting contact in the mold parting plane.

BRIEF DESCRIPTION OF THE DRAWINGS

FIG. 1 is an isometric view of a mold locating core of the present invention.

FIG. 2 is a sectional view through an assembled mold showing the locating core of the present invention in place.

DESCRIPTION OF THE PREFERRED EMBODIMENT

In forming castings a material in liquid form, such as molten metal, is usually poured into a mold cavity through an opening in the upper portion of the mold which communicates through a sprue, a runner and one or more ingates with the mold cavity. Riser cavities are also formed within the mold overlying portions of the mold cavity and in communication therewith. The riser cavities are partly filled by the liquiform material as the mold is filled.

One such mold assembly, is shown in a simple form in FIG. 2 of the drawings. The mold assembly shown therein includes a cope 11, or upper portion, and a drag 12, or lower portion of the mold. The cope and drag each have cavity portions 13 and 14 respectively of the total mold cavity formed therein using the skills and processes well known to those in the foundry arts. The cope and drag may be formed of a mold sand and resin which is thermally set, or may be fabricated from a mold sand and bonding agent which is set by exposing the mixture to a gas. Such a process known in this field using an amine gas is called *Isocure, developed by Ashland Chemical Company, Columbus, Ohio. It should be noted in FIG. 2 that for purposes of clarity the usual core prints, risers and runners associated with the mold cavity portions 13, 14 are not shown as they form no part of the present invention.

*Trademark

The edge of a parting plane 16 is seen in FIG. 2 formed by the abutting surfaces of the cope 11 and the drag 12 when they are placed together in assembled relationship with the respective mold cavities 13 and 14 in proper registration. A description of the manner in which proper registration of the mold cavities is obtained will now be undertaken.

The cope has at least two frusto-conical depressions 17 which are arrayed in a pattern similar to a pattern of frusto-conical depressions 18 in the drag portion of the mold. The maximum diameter of the depressions 17 is larger than the maximum diameter of the depressions 18 as shown. These depressions are sometimes termed core prints.

With reference to FIG. 1, a locating core 19 is shown having an upper frusto-conical portion 21 and a lower frusto-conical portion 22. The truncated cone 21 has a larger base than the truncated cone 22. The locating core is comprised of a unitary assembly of the cone portions 21 and 22 joined at their bases. A step 23 results beginning at the diameter of the base of the cone portion 22 and extending to the diameter of the base of the cone portion 21. As shown in FIG. 1 the step 23 runs about the periphery of the locating core at an intermediate point along the height thereof. The locating core may be formed of the same type of mold sand and bonding agent mixture and by the processes mentioned hereinbefore for forming the cope and drag portions 11 and 12 of the mold assembly.

The upper conical portion 21 of the locating core 19 may be seen to fit within the frusto-conical depressions 17 in the cope 11. In like fashion the cone portion 22 is seen to fit within the frusto-conical depressions 18 in the drag 12. It should also be noticed that the upper cone portion 21 is smaller in height than the depths of the frusto-conical depressions 17 in the cope 11 and the lower cone portion 22 is smaller in height than the depths of the frusto-conical depressions 18 in the drag 12. As a consequence a space is shown between the top of the cone portion 21 and the end of the depressions 17 and between the bottom of the cone portion 22 and the end of the depressions 18 in FIG. 2.

When the mold assembly is to be built, locating cores 19 are placed with the lower frusto-conical portions 22 within the depressions 18 in the drag 12. As a consequence the steps 23 on the locating cores engage the upper surface of the drag along the parting plane 16. Since the depressions 18 are deeper than the heights of the conical portions 22 on the locating core, and since the opening in the parting plane 16 to the depressions 18 is made to be as large as the base of the lower conical portion of the core, the step 23 will always rest on the surface of the drag as described. The upper conical portion 21 is therefore entirely available for engagement in the depressions 17 provided in the cope 11. The cope is thereafter lowered and positioned over the drag so that the depressions 17 engage the walls of the cone portions 21. The opening at the parting surface 16 into the depressions 17 is sufficiently large to accept the base dimension of the upper cone portions and the greater depth in the depressions 17 than the height of the upper cone portion allow the cope to settle onto the upper surface of the drag so that the surface of the cope is in the parting plane 16. In may therefore be seen that the facing surfaces of the cope and the drag are not held apart by the locating cores 19 (they are in abutting engagement) nor are they allowed to move bi-dimensionally within the plane 16. As a result the mold cavities 13 and 14 in the cope and drag respectively are brought into substantially precise alignment so that a cast article removed from the mold cavity after pouring and hardening of the casting material takes the desired shape and dimensions from the mold cavity and avoids the formation of casting material or flashing along the cope and drag parting line because the cope and drag facing surfaces are allowed to abut tightly against one another.

As mentioned hereinbefore one desirable material from which the disclosed locating core may be fabricated is the mold sand used for forming the cone and drag portions of the mold assembly. A representative group of dimensions for one locating core of this type includes a one and one-half inch base dimension for the upper frusto-conical portion 21 and about a three-sixteenths inch step 23 running around the periphery of the locating core intermediate of the top and bottom thereof. The cone sections may have a height which is about one-eighth of an inch less than the depths of the respective depressions 17 and 18 into which they fit. The resulting combination of sand mold material taking the shape described herein, having a peripheral intermediate step and providing a gap as hereinbefore described between the core and the ends of the core prints or depressions in the mold sections provides an accurate and fast way to obtain registration between mold portions requiring minimal cost.

Although the best mode contemplated for carrying out the present invention has been herein shown and described, it will be apparent that modification and variation may be made without departing from what is regarded to be the subject matter of the invention.

What is claimed is:

1. A sand mold assembly defining a mold cavity, comprising a cope portion of the mold a drag portion of the mold, said cope and drag portions having planar surfaces surrounding the mold cavities therein, said surfaces lying in a mold parting plane when said cope and drag are assembled to define the mold cavity, a locating core having a first truncated cone portion and a second truncated cone portion, said first portion having a base larger than the base of said second portion, said first and second portions being joined at said bases, whereby a peripheral step is formed on said core at the junction of said first and second cone portions, said cope and drag portions of the mold each having at least two depressions formed within the mold material and shaped to receive said first and second truncated cone portions respectively, said cone portions having height dimensions which are less than said depression depth dimensions, so that said peripheral step rests on said drag planar surface and said cope and drag surfaces are in abutting contact in said mold parting plane.

2. A sand mold assembly as in claim 1 wherein the cope and drag mold portions are formed of a mixture of mold sand and thermal setting resin, said core comprising a formation of mold sand and thermal setting resin.

3. A sand mold assembly as in claim 1 wherein the cope and drag mold portions are formed of a mixture of mold sand and gas setting resin, said core comprising a formation of mold sand and gas setting resin.

4. A sand mold and locating core assembly providing proper registration between mold cavities in a cope and a drag in a sand mold, wherein the cope and drag each have planar surfaces surrounding the mold cavities therein, comprising at least two frusto-conical depressions within the mold material and extending inwardly in the cope and drag from each of the planar surfaces surrounding the mold cavities, said depressions in the cope having a larger maximum diameter than said depressions in the drag and being in registration therewith when the cope is properly oriented over the drag to thereby form matching sets of depressions, and a locating core to be received in each set of registered depressions, said core including an upper frusto-conical portion and a lower frusto-conical portion, said upper portion having a larger base diameter than said lower portion, said conical portions being joined at the bases thereof, whereby a unitary core is formed and a step on said unitary core extending from the periphery of the base of said lower portion to the periphery of the base of said upper portion, said step being disposed to rest on the planar surface surrounding the drag mold cavity.

5. A sand mold and locating core assembly as in claim 4 wherein said frusto-conical portions comprise truncated cones of lesser height than the depths of the depressions.

6. A sand mold and locating core assembly as in claim 4 wherein said frusto-conical portions comprise a formation of mold sand and bonding agent.

* * * * *